US005723183A

United States Patent [19]

Williams et al.

[11] Patent Number: 5,723,183

[45] Date of Patent: Mar. 3, 1998

[54] METAL COLORING PROCESS

[75] Inventors: Richard K. Williams, Minnetonka; David J. Halverson, Long Lake, both of Minn.; James N. Tuttle, Jr., Harwich Port, Mass.

[73] Assignee: Birchwood Laboratories, Inc., Eden Prairie, Minn.

[21] Appl. No.: 714,550

[22] Filed: Sep. 16, 1996

[51] Int. Cl.[6] ..... B05D 1/38; B05D 3/00; C23C 22/84

[52] U.S. Cl. ..... 427/409; 148/244; 148/252; 427/318; 427/388.4; 427/352; 427/327

[58] Field of Search ..... 427/409, 388.1, 427/388.4, 318, 352, 327; 148/244, 251, 252, 545; 134/3

[56] References Cited

U.S. PATENT DOCUMENTS

| | | | |
|---|---|---|---|
| Re. 34,272 | 6/1993 | Michaud et al. | 156/637 |
| 2,774,696 | 12/1956 | Gibson | 148/6.14 |
| 2,791,525 | 5/1957 | Rausch et al. | 148/6.14 |
| 2,805,969 | 9/1957 | Goodspeed et al. | 148/6.14 |
| 2,835,616 | 5/1958 | Rausch et al. | 148/6.14 |
| 2,850,417 | 9/1958 | Jenkins et al. | 148/6.14 |
| 3,083,149 | 3/1963 | Cranston | 148/244 |
| 3,121,033 | 2/1964 | Stapleton | 148/6.24 |
| 3,481,762 | 12/1969 | Streicher | 117/49 |
| 3,559,280 | 2/1971 | Mailhiot et al. | 427/409 |
| 3,598,659 | 8/1971 | Klingler et al. | 427/409 |
| 3,632,452 | 1/1972 | Matsushima et al. | 148/6.14 |
| 3,649,371 | 3/1972 | Tongyai | 148/6.14 |
| 3,709,742 | 1/1973 | Jacobs | 148/244 |
| 3,753,942 | 8/1973 | Franiau . | |
| 3,806,375 | 4/1974 | McLeod et al. | 148/624 |
| 3,879,237 | 4/1975 | Faigen et al. | 148/6.24 |
| 3,936,445 | 2/1976 | Pfitzner et al. | 260/239 |
| 4,018,934 | 4/1977 | Parliament | 426/540 |
| 4,086,182 | 4/1978 | Hengelhaupt et al. | 252/182 |
| 4,656,097 | 4/1987 | Claffey et al. | 428/457 |
| 4,781,948 | 11/1988 | Caldwell | 427/388.4 |
| 4,944,812 | 7/1990 | Lindert et al. | 106/14.15 |
| 5,320,872 | 6/1994 | McNeel et al. | 427/408 |
| 5,466,297 | 11/1995 | Goodman et al. | 134/3 |

*Primary Examiner*—Diana Dudash
*Attorney, Agent, or Firm*—Vidas, Arrett & Steinkraus, P.A.

[57] ABSTRACT

The invention is the chemical composition and method for forming a chemical conversion coating on ferrous metal surfaces and subsequent coloring of said conversion coating through the application of a water-soluble dye. The conversion coating has an ordered crystalline structure composed of ferrous oxalate or other ferrous dicarboxylates. The conversion coating can be colored through the application of a water-soluble reactive dye which bonds with Fe (II) within the ferrous dicarboxylate matrix, bound to the dicarboxylate molecules, thereby becoming water insoluble and permanent. When sealed with an appropriate rust preventive top coat, the result is an attractive and protective finish of minimal thickness which can be applied through simple immersion process techniques. Said finish can serve as a final protective finish on a fabricated ferrous metal article and also affords a degree of lubricity for assembly, break-in purposes, or anti-galling protection and serves as an adhesive base for paint.

11 Claims, No Drawings

METAL COLORING PROCESS

BACKGROUND OF THE INVENTION

1. Field of the Invention

This invention relates to coloring a dicarboxylate conversion coating on metals.

2. Description of the Related Art

The established art of coloring ferrous metals has revolved principally around methods for producing black coatings. Besides painting or electroplating methods, there are four generally accepted methods for producing colored conversion coating finishes:

1. Caustic black oxidizing. This process oxidizes the metallic iron by nitrate/nitrite, operating at a pH of 14 at 285°–295° F. The method produces a black iron magnetite ($Fe_3O_4$) compound on the surface, during a 5–20 minute exposure. Although the process produces good quality coatings it has the disadvantage of requiring high temperatures and extremely concentrated solutions of sodium hydroxide (6–8 lb/gal) to raise the pH and boiling point sufficiently to initiate the reaction. As a result, the operation of the process poses severe safety hazards and is difficult to justify in the legal and manufacturing environments commonly seen in modern industry.

2. Steam blackening. This method utilizes a pressurized vessel containing the articles to be blackened. Hot steam is injected into the vessel at temperatures from 800°–1400° F. and maintained for 20–45 minutes to form black iron magnetite ($Fe_3O_4$) on the surface of the metal parts. The black finish is quite dense and durable. The equipment costs are extremely high, however. And the high temperatures and pressures involved make the process too dangerous and time consuming for most manufacturers to consider using.

3. Black phosphatizing. In this area, there are two possible coatings—the black manganese phosphate or a black dyed, tin modified zinc phosphate coating. Both methods produce heavy weight phosphate coatings which, when properly sealed, provide extremely high levels of corrosion resistance. However, a long and complex process line is required for either method. In addition, the resultant coating is usually quite thick with a very coarse crystal structure. Though suitable for articles used in severe service (such as military weapons), these finishes are too coarse and too thick to be suitable for the machine/tool industry, which generally requires an essentially non-dimensional finish of fine grain.

4. Room temperature blackening. This method utilizes a copper and selenium-based oxidation/reduction reaction to form a black cupric selenide (CuSe) coating on the surface of the parts. The coating is quite thin (1 micron) and of a fine grain. In addition, the process is generally regarded as safe and easy to use, by virtue of the room temperature blackening reaction. However, the black finish is too fragile for some applications with insufficient wear resistance. In addition, the copper and selenium residues are both regulated by the Environmental Protection Agency ("EPA"). Consequently, these process lines require waste treatment of some type in order to operate in compliance with existing pollution regulations.

There have been several patents issued over the years which relate specifically to the formation of oxalate-based coatings on ferrous metal substrates:

| U.S. Pat. No. | Date | Subject |
|---|---|---|
| 2,774,696 | 12/18/56 | oxalate coatings on chromium alloy substrates. |
| 2,791,525 | 5/7/57 | chlorate accelerated oxalate coatings on ferrous metals for forming lubricity and paint adhesion. |
| 2,805,969 | 9/10/57 | molybdenum accelerated oxalate coatings. |
| 2,850,417 | 9/2/58 | m-nitrobenzene sulfonate accelerated oxalates on ferrous metals. |
| 2,835,616 | 5/20/58 | method of processing ferrous metals to form oxalate coating. |
| 3,121,033 | 2/11/64 | oxalates on stainless steels. |
| 3,481,762 | 12/2/69 | manganous oxalates sealed with graphite and oil for forming lubricity. |
| 3,632,452 | 9/17/58 | stannous accelerated oxalates on stainless steels. |
| 3,649,371 | 3/14/72 | fluoride modified oxalates; method for. |
| 3,806,375 | 4/23/75 | hexamine/$SO_2$ accelerated oxalates. |
| 3,879,237 | 4/22/75 | manganese, fluoride, sulfide accelerated oxalates. |

All of these prior patents focus on forming an oxalate coating on ferrous alloys using various accelerants, then topcoating with a rust preventive compound for corrosion resistance or lubricity in forming operations. In other words, all the above patents focus on the functional value of the oxalate coating. This invention focuses on the oxalate (or dicarboxylate) coating used in conjunction with a separate coloring operation for enhanced aesthetic, protective and functional value.

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. §1.56(a) exists.

SUMMARY OF THE INVENTION

The invention provides an alternative method and composition for providing aesthetically pleasing and protective colored coatings on ferrous metal substrates. The process consists of cleaning the metal surface to remove foreign soils and oxides in a manner known to those skilled in the art of metal finishing; then contacting the metal article with an aqueous dicarboxylate forming solution for a time sufficient to coat the surface. Following this step, the dicarboxylate coating is colored by means of contact with an aqueous dye solution to provide a color to the metal surface. After the coloring operation, the coating may be topcoated with a material appropriate to the end use of the article.

DESCRIPTION OF THE PREFERRED EMBODIMENTS

A ferrous metal substrate is defined herein as any metallic substrate whose composition is primarily iron. This may include steel, stainless steel, cast iron, gray and ductile iron and powdered metal of all alloys. The invention process may be carried out as follows:

Step 1 The article is cleaned, degreased and descaled (if necessary) to remove foreign materials such as fabricating oils, coolants, extraneous lubricants, rust, millscale, heat treat scale, etc. The aim here is to generate a metal surface which is free of oils and oxides, exposing a uniform and reactive metal surface. Conventional and acceptable methods include cleaning in an alkaline detergent soak cleaner, solvent degreasing or electrocleaning. Descaling can be accomplished by acid or caustic descaling methods which are commonly known to the industry. Abrasive cleaning methods such as bead blasting, shot peening, and vapor honing may be used with good results.

Step 2 The article is rinsed in clean water to remove any cleaning residues from the surface.

Step 3 The article is then coated with a water insoluble dicarboxylate-based deposit by contacting the article with an aqueous solution of a dicarboxylic acid, preferably oxalic acid, and an appropriate accelerant for a time sufficient to form a noticeable coating, usually 1–3 minutes at temperatures from 50°–150° F. The dicarboxylate coating is usually opaque-gray in color.

Step 4 The article is rinsed in clean water to remove any acid solution residue from the surface.

Step 5 The article is then colored by contacting it with an aqueous solution of a reactive dye for a time sufficient to achieve the desired color on the surface of the part, usually 1–5 minutes at temperatures from 50°–150° F. The resulting coating may be black in color, or any other color, depending on the particular dye used.

Step 6 The article is rinsed in clean water to remove any dye residues from the surface.

Step 7 The article is then sealed by contacting it with a topcoat appropriate to the end use of the article: a lubricant, rust preventive or polymer-based product.

The dicarboxylate coating is formed by an aqueous solution of 2–50 grams/liter ("g/l") of a dicarboxylic acid, such as oxalic acid, an appropriate accelerant such as chlorate, molybdate, sulfide or a nitro compound, as detailed in the prior art described earlier. There are some advantages and disadvantages to each accelerant—for example, the chlorate appears to have the highest activity level and raises the reaction rate to the greatest degree. However, it tends to favor the formation of a loosely adherent soot or powdery layer when used on metal substrates that are also very reactive. Consequently, the chlorate may be the best accelerant for substrates such as stainless steel or higher steel alloys which require a higher activity level. However, for the lower alloys or more reactive alloys, a chlorate accelerant is not the material of choice.

A sulfide accelerant tends to favor the formation of gaseous sulfide compounds which could represent an odor problem when used on certain reactive alloys. In addition, the sulfide may tend to migrate through the grain structure of the steel alloy and reduce the load bearing strength of the substrate metal.

The molybdate and organic nitro compounds tend to act in a more moderate activity range, making them the preferred accelerants for most steels commonly encountered in the machine/tool industry. However, these materials do not generate the activity level necessary for successful coating of the higher, less reactive alloys.

The dicarboxylate coating can be formed using any of the water soluble dicarboxylic acids, especially aliphatic dicarboxylic acids, such as oxalic, malonic, succinic, tartaric, and others. Again, there are advantages and disadvantages to each. For example, oxalic is generally available at the lowest commercial cost. A mixture of two or more dicarboxylic acids, however, tends to favor the formation of a denser crystalline structure on the metallic surface, thereby increasing the scratch and wear resistance and the gloss of the resultant coating. The precise mixture of acids can vary in a way appropriate to the reactivity of the substrate. For example, for certain low value articles, one may choose to use oxalic acid exclusively, for reasons related to cost of the chemicals. In this case, the resultant coating may exhibit a less dense crystalline structure which has a higher degree of porosity. This type of coating would tend to absorb more rust preventive oil, and would have a matte, non-reflective surface. As such, the coating could be regarded as a functional, protective coating with low light reflection and excellent forming lubricity.

On the other hand, when a mixture of dicarboxylic acids is used in the solution, the resultant crystalline structure tends to be more densely formed. As such, the molecular surface of the coating would be less jagged and smoother, with the result on a macro scale being a more reflective or glossy coating. This type of mixed dicarboxylic acid solution may be preferred when coating articles of higher value or higher visibility in service and which have a higher aesthetic requirement. In many applications, a glossy black finish is preferred over a matte black finish. If so, the mixed dicarboxylic acid solution may be the preferred composition for aesthetic reasons, but would have a higher cost as well.

After coating with the dicarboxylate coating, the article is colored by contact with an aqueous reactive dye. The dye can be of any color, though some dyes are more effective than others. The dye solution should be maintained at a pH of3.0–11.0 at a temperature of 50°–150° F. Contact time and temperature can vary, depending on the activity level of the particular dye employed. Since the dye is a reactive material, the color imparted to the dicarboxylate coating will tend to become more intense with increased contact time and higher temperature. Again, the optimum application can vary, depending on the reactivity of the base metal and this activity level of the particular dye. A certain minimum contact time seems to be necessary—about 2 minutes—for most ferrous substrates.

The dye actually carries out a chemical reaction with the iron (II) contained in the ferrous dicarboxylate coating by forming insoluble colored complexes and compounds. Experimental evidence indicates that dyes of many types of molecular structures could work in the intended manner as long as they have the ability to bond with iron (II). For this invention, then, a suitable dye would be one which has a structure that produces a desired color and which contains an end group capable of bonding with iron (II).

A myriad of possibilities may exist in terms of usable colors and the molecular structures which product these colors. However, there are only a few end group structures which are capable of bonding with iron (II).

Experimental evidence indicates that the best results are obtained when the end "iron bonding group" includes an outer benzene ring containing a carboxyl group and a hydroxyl group in a vicinal configuration. One may accurately describe this end group as an orthocarboxyphenol, or, perhaps more succinctly, a salicylate.

In the salicylate structure, the carboxyl and hydroxyl groups tend to form a stable six-membered ring structure of which iron is a member.

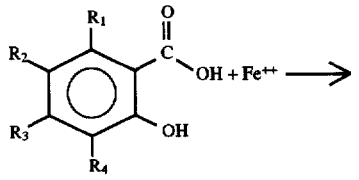

-continued

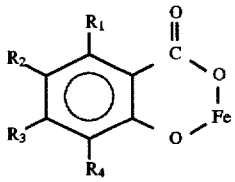

Where $R_1$, $R_2$ & $R_4$ may be simple side groups such as hydrogen, hydroxyl, methyl or halide, and where $R_3$ is usually a conjugated dye structure responsible for the color of the dye. It is believed that $R_3$, the conjugated dye structure, must be in a meta or para position with respect to the reactive iron bonding groups in order to avoid steric hindrance of the reaction.

It is also possible to utilize other dyes whose structures form five-membered

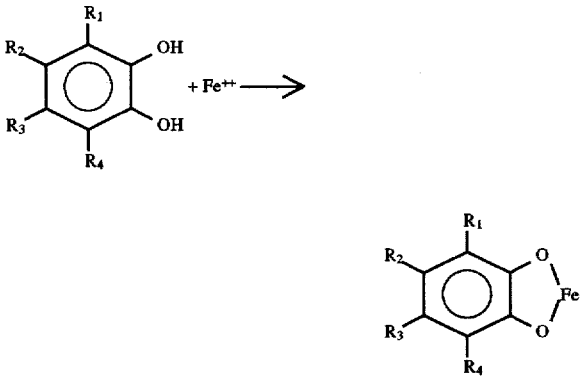

rings with iron. Examples of these dyes includes those whose structures include outer benzene rings with vicinal hydroxyl groups. (e.g., tannic acid).

Additionally, it is possible to use more than one dye simultaneously to affect the color produced on the dicarboxylate coating. Certain combinations may tend to produce more intense colors than others. Because the relative reactivities of the base metal, the oxalate forming solution and the dye solution may tend to be different, some experimentation may be required to optimize results.

A variety of colors may be imparted to the metal substrates according to this invention. Blue can be imparted by using the Mordant Blue #1 dye (Color Index #43830) of Organic Dyestuffs, Inc. at about 1.0 g/l at a pH of about 6.0–6.5. A black color may be achieved by using a mixture of 91% Hematine LG (Color Index #75290) from Abby Color and 9% Mordant Orange (Color Index #14030) from Organic Dyestuff Corporation at about 12.5 g/l and a pH about 4.75–6.0. Other colors and combinations are possible using different dyes.

As a general rule, it should be understood that the variables described above may not always be completely predictable. The overall chemical reactivity of any ferrous material is affected by the alloy, i.e., the surface hardness and the smoothness. In like manner, the overall reactivity of the dicarboxylic acid mixture is affected by the type and concentration of acids employed as well as the type and concentration of accelerant used and the temperature and contact time employed in processing articles. This wide range of variables must be reconciled by trial and error, in many cases, in order to appropriately match the reactivity of the base metal with that of the dicarboxylate solution. If the dicarboxylic acid solution is too reactive for the alloy being processed, the result may be a sooty or loosely adherent deposit due to high reaction rates and excessive dissolution of metallic iron. The result will be a spongy deposit with poor wear resistance.

On the other hand, if the dicarboxylic acid solution is not reactive enough for the alloy being processed, the reaction will proceed very slowly, forming a very dense, tightly adherent deposit, but one which is too thin to absorb the dye appropriately.

Consequently, some experience with these various combinations is usually helpful in determining the optimum process cycle for the articles being processed.

EXAMPLE 1

A 1018 steel article is cleaned by conventional means. It is then immersed for 2 minutes at room temperature in an aqueous solution containing:

20 g/l oxalic acid 5 g/l m-nitrobenzoic acid 0.1 g/l Triton X100 wetting agent (Rohm & Haas Company)

The above immersion will produce an opaque-gray oxalate coating on the steel surface.

After rinsing, the article is immersed for 2 minutes at room temperature in an aqueous solution of:

4 g/l mordant blue dye (Color Index #43830)

3.5 g/l mordant black dye (Color Index #26695)

During this immersion, the article will take on a black color due to reaction with and absorption of the dye mixture. The article is then rinsed in clean water and sealed in a water-displacing oil topcoat which serves as a rust preventive.

The resultant coating will be a matte, non-reflective black coating, tightly adherent, with corrosion resistance equal to that provided by the topcoat oil sealant.

EXAMPLE 2

A 4140 heat treated steel cutting tool is cleaned and descaled by conventional means. The tool is then immersed for 2 minutes at room temperature in an aqueous solution containing:

17 g/l oxalic acid 3 g/l citric acid 3 g/l tartaric acid 0.1 g/l TX100 wetting agent (Rohm & Haas Co.)

2 g/l sodium chlorate

The above immersion will produce an opaque gray dicarboxylate coating on the steel surface.

After rinsing, the article is immersed for 3–4 minutes at room temperature in an aqueous solution containing:

4 g/l mordant blue dye 3.5 g/l mordant black dye

During this immersion, the article will take on a black color due to reaction with and absorption of the dye mixture. The article is then rinsed in clean water and sealed in a water-displacing oil topcoat which serves as a rust preventive.

The resultant finish will be somewhat denser and more reflective than that produced in Example 1. The higher alloy with a harder surface is a less reactive material than the 1018 soft steel processed in Example 1. Consequently, the use of the more reactive chlorate accelerant is appropriate for this application, even though it may not have been the material of choice for Example 1.

EXAMPLE 3

A cast iron article is cleaned by conventional means. The article is then immersed for two minutes at room temperature in an aqueous solution containing:

20 g/l oxalic acid 0.1 g/l tx100 wetting agent (Rohm & Haas Co.)

5.0 g/l ammonium molybdate

The above immersion will produce an opaque, dark gray oxalate coating on the iron surface. After rinsing, the article is immersed for 2–3 minutes at 130° F. in an aqueous solution (at pH 3.0) containing:

3.0 g/l tannic acid

During this immersion, the article will take on a deep blue/black color due to the reaction with the tannic acid mixture. The article is then rinsed in clean water and sealed in a water-displacing oil topcoat which serves as a rust preventive.

The resultant finish will be somewhat less reflective and more porous than that produced in Example 1. As such, the finish may be regarded as satisfying a lower aesthetic requirement than that in Example 2. However, the oxalate coating will be somewhat thicker due to the higher reactivity of the base metal. Consequently the black coating will offer enhanced protection from galling and will absorb more rust preventive oil for increased corrosion resistance.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

This completes the description of the preferred and alternate embodiments of the invention. Those skilled in the art may recognize other equivalents to the specific embodiment described herein which equivalents are intended to be encompassed by the claims attached hereto.

What is claimed is:

1. A process for forming a coating on ferrous metal substrates comprising the steps of:

a) cleaning a ferrous metal substrate to be coated;

b) coating the substrate with a dicarboxylic acid in the presence of an accelerant;

c) rinsing the substrate to remove dicarboxylic acid residue;

d) coloring the substrate by immersing the coated substrate in an aqueous solution consisting essentially of a reactive dye that produces a desired color at an appropriate pH and temperature and for a sufficient time period to achieve the desired color.

2. The process of claim 1, wherein the dicarboxylic acid is selected from the group consisting of oxalic acid, malonic acid, succinic acid, citric acid and tartaric acid.

3. The process of claim 2, wherein the dicarboxylic acid is oxalic acid.

4. The process of claim 1, wherein the accelerant is selected from the group consisting of chlorate, molybdate, sulfide and a nitro compound.

5. The process of claim 1, further comprising the step of sealing the colored substrate by contacting it with a topcoat.

6. The process of claim 5, wherein the topcoat is chosen from the group consisting of a lubricant, a rust preventive product and a polymeric product.

7. The process of claim 1 wherein said reactive dye is an aqueous organic dye having an end group capable of chemically reacting with iron (II).

8. The process of claim 7, wherein the coated substrate is colored at a temperature of between about 50° to about 150° F.

9. The process of claim 8, wherein the substrate is coated at a temperature of between about 50° to about 150° F.

10. The process of claim 1 wherein said reactive dye is an aqueous organic dye having an end group capable of chemically reacting with iron (II), said end group selected from the group consisting of salicylates and vicinal dihydroxy benzene rings, and mixtures of same.

11. The process of claim 1 wherein said reactive dye is selected from the group consisting of tannic acid, mordant blue and mordant black, hematine LG and mordant orange, and mixtures thereof.

* * * * *